US010651611B2

(12) United States Patent
Okada et al.

(10) Patent No.: US 10,651,611 B2
(45) Date of Patent: May 12, 2020

(54) L-TYPE COAXIAL CONNECTOR AND METHOD FOR MANUFACTURING L-TYPE COAXIAL CONNECTOR

(71) Applicant: Murata Manufacturing Co., Ltd., Kyoto-fu (JP)

(72) Inventors: Daisuke Okada, Nagaokakyo (JP); Yoshihiro Himi, Nagaokakyo (JP); Katsumi Kohnishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/404,492

(22) Filed: May 6, 2019

(65) Prior Publication Data

US 2019/0260168 A1 Aug. 22, 2019

Related U.S. Application Data

(63) Continuation of application No. PCT/JP2017/035782, filed on Oct. 2, 2017.

(30) Foreign Application Priority Data

Nov. 7, 2016 (JP) ..... 2016-217283

(51) Int. Cl.
*H01R 9/05* (2006.01)
*H01R 24/38* (2011.01)
(Continued)

(52) U.S. Cl.
CPC ..... *H01R 24/38* (2013.01); *H01R 9/0503* (2013.01); *H01R 9/0518* (2013.01);
(Continued)

(58) Field of Classification Search
CPC ..... H01R 4/187; H01R 4/029; H01R 4/023; H01R 9/0518; H01R 24/545
See application file for complete search history.

(56) References Cited

U.S. PATENT DOCUMENTS 4,966,565 A * 10/1990 Dohi ..... H01R 4/029 439/874
5,725,400 A * 3/1998 Morikawa ..... B23K 1/0016 439/874
(Continued)

FOREIGN PATENT DOCUMENTS

CN 101673908 A 3/2010
JP S49-146453 U 12/1974
(Continued)

OTHER PUBLICATIONS

International Search Report issued in PCT/JP2017/035782; dated Dec. 12, 2017.
(Continued)

*Primary Examiner* — Tho D Ta
(74) *Attorney, Agent, or Firm* — Studebaker & Brackett PC

(57) ABSTRACT

An L-type coaxial connector is connected to a coaxial cable including a central conductor and an external conductor, and includes a housing, a bushing, and a socket. The housing includes a housing main body, a back-side section, and a crimp section. The housing main body has a first cut section. The back-side section includes a lid section and an extending section extending from the lid section and above which the external conductor is placed. The crimp section extends from the extending section, and its leading end section is bent so as to be opposed to the extending section such that the coaxial cable is interposed therebetween. The extending section has a second cut section, and a joining member joining the external conductor and the extending section is present inside the second cut section.

14 Claims, 4 Drawing Sheets

(51) Int. Cl.

| | |
|---|---|
| ***H01R 43/048*** | (2006.01) |
| ***H01R 13/6473*** | (2011.01) |
| *H01R 4/02* | (2006.01) |
| *H01R 24/54* | (2011.01) |
| *H01R 4/18* | (2006.01) |

(52) U.S. Cl.
CPC ..... *H01R 13/6473* (2013.01); *H01R 43/048* (2013.01); *H01R 4/023* (2013.01); *H01R 4/029* (2013.01); *H01R 4/187* (2013.01); *H01R 24/545* (2013.01)

(56) References Cited

U.S. PATENT DOCUMENTS

| | | | | |
|---|---|---|---|---|
| 5,785,555 | A * | 7/1998 | O'Sullivan | H01R 4/187 439/579 |
| 7,972,174 | B2 * | 7/2011 | Maruyama | H01R 9/0518 439/582 |
| 9,190,741 | B2 * | 11/2015 | Cawood | H01R 4/187 |
| 2010/0062640 | A1 | 3/2010 | Maruyama et al. | |

FOREIGN PATENT DOCUMENTS

| | | | |
|---|---|---|---|
| JP | S55-168975 | U | 12/1980 |
| JP | S57-212790 | A | 12/1982 |
| JP | 2000-012184 | A | 1/2000 |
| JP | 2009-217976 | A | 9/2009 |
| JP | 2010-067425 | A | 3/2010 |
| JP | 2013-093212 | A | 5/2013 |
| JP | 2016-024923 | A | 2/2016 |

OTHER PUBLICATIONS

International Preliminary Report on Patentability and Written Opinion issued in PCT/JP2017/035782; dated May 7, 2019.

* cited by examiner

Prior Art

L-TYPE COAXIAL CONNECTOR AND METHOD FOR MANUFACTURING L-TYPE COAXIAL CONNECTOR

CROSS-REFERENCE TO RELATED APPLICATIONS

This application claims benefit of priority to International Patent Application No. PCT/JP2017/035782, filed Oct. 2, 2017, and to Japanese Patent Application No. 2016-217283, filed Nov. 7, 2016, the entire contents of each are incorporated herein by reference.

BACKGROUND

Technical Field

The present disclosure relates to an L-type coaxial connector connected to a coaxial cable including a central conductor and an external conductor, and to a method for manufacturing the L-type coaxial connector.

Background Art

One example of an L-type coaxial connector connected to a coaxial cable including a central conductor and an external conductor is an L-type coaxial connector described in Japanese Unexamined Patent Application Publication No. 2010-67425. FIG. 5 is a perspective view of an L-type coaxial connector 300 described in Japanese Unexamined Patent Application Publication No. 2010-67425. The L-type coaxial connector 300 is connected to a coaxial cable 350 including a central conductor 351, an external conductor 352, an insulating film 353 that insulates the central conductor 351 and external conductor 352 from each other, and an outermost protective film 354.

The L-type coaxial connector 300 includes a housing 310, a bushing 320, and a socket 330. The housing 310 includes a housing main body 311, a back-side section 312, a support section 313, and a crimp section 314. The housing main body 311 is a substantially cylindrical shape and includes a first opening 315 and a second opening 316. The housing main body 311 has a cut section 317 in its side surface. The back-side section 312 includes a lid section 312*a* covering the second opening 316 and an extending section 312*b* extending from the lid section 312*a* and above which the external conductor 352 is placed.

The support section 313 is disposed on the housing main body 311. The crimp section 314 extends from the extending section 312*b* and includes a leading end section bent so as to be opposed to the extending section 312*b* such that the coaxial cable 350 is interposed therebetween. In the L-type coaxial connector 300, the crimp section 314 is formed by bending a first-side crimp member 314*a* and a second-side crimp member 314*b* as described above. The first-side crimp member 314*a* includes a first member 314$a_1$, a second member 314$a_2$, and a third member 314$a_3$. The second-side crimp member 314*b* includes a first member 314$b_1$, a second member 314$b_2$, and a third member 314$b_3$.

The bushing 320 is attached inside the housing 310. The socket 330 is mounted inside the bushing 320 in a state where the socket 330 is insulated from the housing 310 by the bushing 320 and is connected to the central conductor 351.

SUMMARY

The coaxial cable 350 is fixed to in the L-type coaxial connector 300 by forming the crimp section 314 as described above in the state where the exposed external conductor 352 is placed above the extending section 312*b*. That is, the coaxial cable 350 is compressed and fixed by bending the first-side crimp member 314*a* and second-side crimp member 314*b* and strongly crimping the coaxial cable 350.

However, when the strong crimping applies an excessive pressure on the coaxial cable 350, the external conductor 352 and insulating film 353 may be deformed. In that case, the impedance of the coaxial cable 350 deviates from a desired value, and designed electric characteristics may not be obtained.

Thus, the present disclosure provides an L-type coaxial connector capable of suppressing deviation in impedance of a coaxial cable during connection and maintaining sufficient connection strength to the coaxial cable.

The L-type coaxial connector according to the present disclosure has an improved housing structure, in particular, an improved structure of a back-side section included in the housing.

A first embodiment of the L-type coaxial connector according to the present disclosure is connected to a coaxial cable including a central conductor, an external conductor, and an insulating film that insulates the central conductor and the external conductor from each other. The L-type coaxial connector includes a housing, a bushing attached inside the housing, and a socket attached inside the bushing in a state where the socket is insulated from the housing by the bushing and is connected to the central conductor.

The housing includes a housing main body, a back-side section, and a crimp section. The housing main body has a first opening and a second opening and has a first cut section formed in a side surface thereof. The back-side section includes a lid section covering the second opening of the housing main body and an extending section extending from the lid section and above which the external conductor is placed. The crimp section extends from the extending section and has a leading end section bent so as to be opposed to the extending section such that the coaxial cable is interposed therebetween.

The extending section has a second cut section, and a joining member that joins the external conductor and the extending section is present in at least a portion inside the second cut section.

In the above-described L-type coaxial connector, fixing by the crimp section and joining between the external conductor and the back-side section (extending section) in the housing by the joining member are both used. That is, because the crimping by the crimp section is not strong, deformation of the external conductor and insulating film in the coaxial cable during connection is suppressed. Thus, deviation in impedance of the coaxial cable is suppressed. Moreover, sufficient connection strength is maintained between the L-type coaxial connector and the coaxial cable.

The first embodiment of the L-type coaxial connector according to the present disclosure may preferably have characteristics described below. That is, the second cut section may be a through hole having a first opening on a side corresponding to an external surface of the extending section and a second opening on a side where the external conductor is placed, and a perimeter of each of the first opening of the through hole and the second opening of the through hole may be positioned in the extending section.

In the above-described L-type coaxial connector, because the second cut section is a through hole formed in the extending section, the joining member is filled over the perimeters of the first opening of the through hole and the second opening of the through hole. Thus, the joining strength between the external conductor and the extending section is high.

When the second cut section is the above-described through hole, the L-type coaxial connector according to the present disclosure may preferably further have characteristics described below. That is, the through hole may have a tapered region whose cross-sectional area increases in a direction from the second opening of the through hole toward the first opening of the through hole.

In the above-described L-type coaxial connector, the tapered region enables the previous structure of the joining member to be easily held inside the through hole. Thus, the joining strength between the external conductor and the extending section is higher. Moreover, an overflow of the joining member to the outer side of the extending section is suppressed.

A second embodiment of the L-type coaxial connector according to the present disclosure is connected to a coaxial cable including a central conductor, an external conductor, and an insulating film that insulates the central conductor and the external conductor from each other, as in the case of the first embodiment. The L-type coaxial connector includes a housing, a bushing attached inside the housing, and a socket attached inside the bushing in a state where the socket is insulated from the housing by the bushing and is connected to the central conductor.

The housing includes a housing main body, a back-side section, and a crimp section. The housing main body has a first opening and a second opening and has a first cut section formed in a side surface thereof. The back-side section includes a lid section covering the second opening of the housing main body and an extending section extending from the lid section and above which the external conductor is placed. The crimp section extends from the extending section and has a leading end section bent so as to be opposed to the extending section such that the coaxial cable is interposed therebetween.

A joining member that joins the external conductor and the extending section is present in at least a portion between the external conductor and the extending section.

In the above-described L-type coaxial connector, fixing by the crimp section and joining between the external conductor and the back-side section (extending section) in the housing by the joining member are also both used, as in the case of the first embodiment. That is, because the crimping by the crimp section is not strong, deformation of the external conductor and insulating film in the coaxial cable during connection is suppressed. Thus, deviation in impedance of the coaxial cable is suppressed. Moreover, sufficient connection strength is maintained between the L-type coaxial connector and the coaxial cable.

The first embodiment and its preferred embodiments of the L-type coaxial connector according to the present disclosure and the second embodiment of the L-type coaxial connector may preferably have characteristics described below. That is, the joining member may be formed by using an alloy containing tin.

Because the joining member in the above-described L-type coaxial connector is an alloy with high strength, such as tin-based lead-free solder, the connection strength between the external conductor and the extending section is high.

When the joining member is formed by using the alloy containing tin, the L-type coaxial connector according to the present disclosure may preferably have characteristics described below. That is, a tin film or an alloy film containing tin may be provided to the side where the external conductor is placed of the extending section.

In the above-described L-type coaxial connector, because the tin film or the alloy film containing tin on the side where the external conductor is placed of the extending section and the joining member, which is the alloy containing tin, are joined firmly, the connection strength between the external conductor and the extending section is higher.

A first embodiment of a method for manufacturing an L-type coaxial connector according to the present disclosure includes first to seventh steps described below. The L-type coaxial connector is connected to a coaxial cable including a central conductor, an external conductor, and an insulating film that insulates the central conductor and the external conductor from each other.

The first step is a step of preparing or producing a housing, a bushing, and a socket. The housing includes a housing main body, a back-side section, and a crimp member. The housing main body has a first opening and a second opening and has a first cut section formed in a side surface thereof. The back-side section includes a lid section covering the second opening of the housing main body and an extending section extending from the lid section and having a second cut section. The crimp member extends from the extending section.

The second step is a step of attaching the socket inside the bushing. The third step is a step of attaching the bushing with the socket attached therein inside the housing such that the socket is insulated from the housing by the bushing. The fourth step is a step of providing a previous structure of a joining member to at least a portion of the second cut section. The fifth step is a step of connecting the central conductor and the socket and placing the exposed external conductor above the extending section.

The sixth step is a step of forming a crimp section by bending a leading end section of the crimp member so as to be opposed to the extending section such that the coaxial cable is interposed therebetween. The seventh step is a step of heating the previous structure of the joining member and forming the previous structure of the joining member into the joining member joining the external conductor and the extending section.

With the above-described method for manufacturing the L-type coaxial connector, the L-type coaxial connector to which the coaxial cable is fixed with sufficient connection strength without strong crimping by the crimp section can be manufactured efficiently.

A second embodiment of the method for manufacturing the L-type coaxial connector according to the present disclosure includes first to seventh steps described below. The L-type coaxial connector is connected to a coaxial cable including a central conductor, an external conductor, and an insulating film that insulates the central conductor and the external conductor from each other.

The first step is a step of preparing or producing a housing, a bushing, and a socket. The housing includes a housing main body, a back-side section, and a crimp member. The housing main body has a first opening and a second opening and has a first cut section formed in a side surface thereof. The back-side section includes a lid section covering the second opening of the housing main body and an extending section extending from the lid section. The crimp member extends from the extending section.

The second step is a step of attaching the socket inside the bushing. The third step is a step of attaching the bushing with the socket attached therein inside the housing such that the socket is insulated from the housing by the bushing. The fourth step is a step of providing a previous structure of a joining member to at least a portion of an exposed external surface of the external conductor. The fifth step is a step of connecting the central conductor and the socket and placing the external conductor above the extending section such that the previous structure of the joining member is present in at least a portion between the external conductor and the extending section.

The sixth step is a step of forming a crimp section by bending a leading end section of the crimp member so as to be opposed to the extending section such that the coaxial cable is interposed therebetween. The seventh step is a step of heating the previous structure of the joining member and forming the previous structure of the joining member into the joining member joining the external conductor and the extending section.

With the above-described method for manufacturing the L-type coaxial connector, the L-type coaxial connector to which the coaxial cable is fixed with sufficient connection strength without strong crimping by the crimp section can also be manufactured efficiently, as in the case of the first embodiment.

In the L-type coaxial connector according to the present disclosure, fixing by the crimp section and joining between the external conductor and the back-side section (extending section) in the housing by the joining member are both used. That is, because the crimping by the crimp section is not strong, deformation of the external conductor and insulating film in the coaxial cable during connection is suppressed. Thus, deviation in impedance of the coaxial cable is suppressed. Moreover, sufficient connection strength is maintained between the L-type coaxial connector and the coaxial cable.

With the method for manufacturing the L-type coaxial connector according to the present disclosure, the L-type coaxial connector to which the coaxial cable is fixed with sufficient connection strength without strong crimping by the crimp section can be manufactured efficiently.

DETAILED DESCRIPTION

Figure 1:
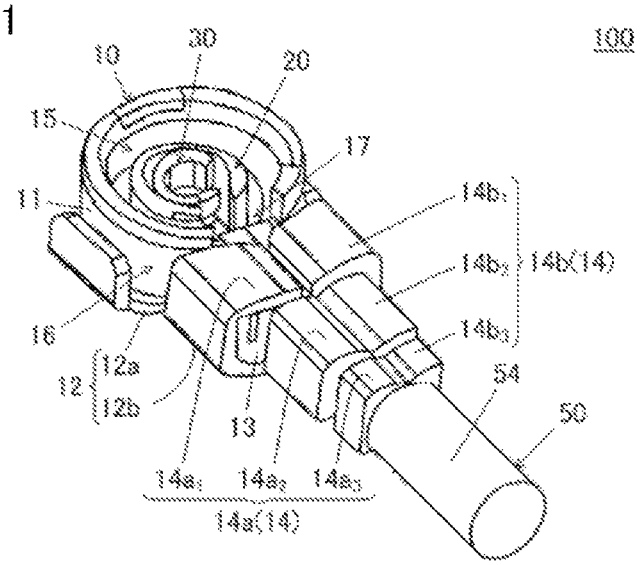
FIG. 1 is a perspective view of an L-type coaxial connector being a first embodiment of an L-type coaxial connector according to the present disclosure.

Embodiments of the present disclosure are described below, and the characteristics of the present disclosure are explained in further details. The present disclosure is applicable to L-type coaxial connectors used in, for example, measurement of electric characteristics for product inspection of portable electronic devices, and it is also applicable to other L-type coaxial connectors.

First Embodiment of L-type Coaxial Connector

<Structure of L-type Coaxial Connector>

The structure of an L-type coaxial connector 100 being a first embodiment of a measurement probe according to the present disclosure is described with reference to FIGS. 1 to 3.

The drawings are schematic views and may not express the dimensions of a real product. Variations in shapes of constituent elements produced in a manufacturing process and the like also may not be expressed in the drawings. That is, the drawings used for description below in the present specification can be considered that they essentially indicate real products even when there are differences from the real products.

Figure 2:
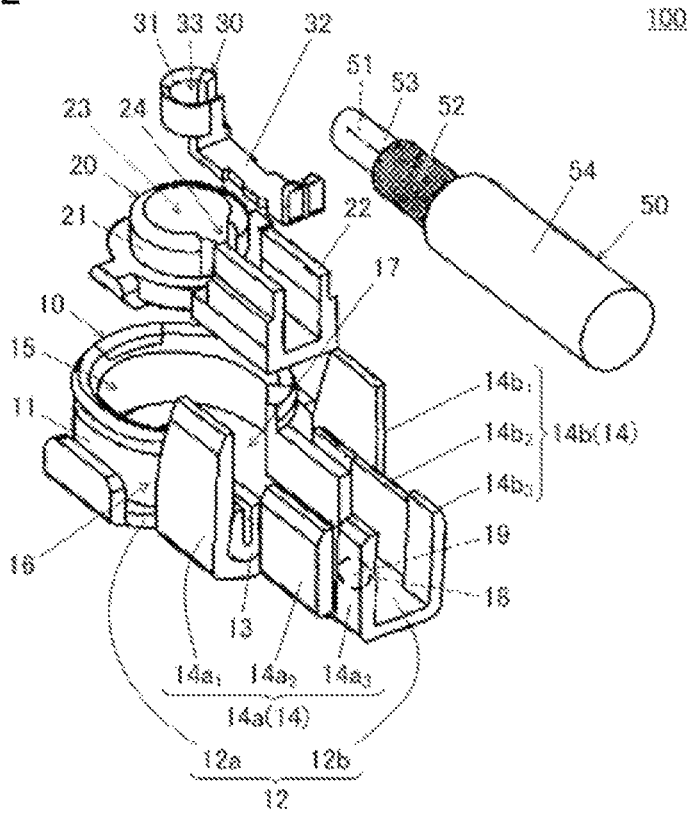
FIG. 2 is a perspective view that illustrates elements before the L-type coaxial connector is assembled.
Figure 3A:
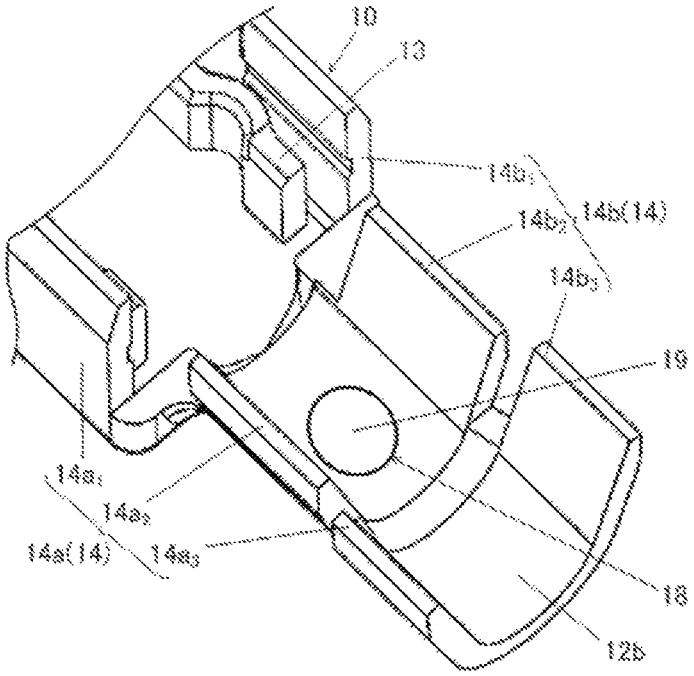
FIG. 3A is an enlarged perspective view that illustrates a back-side section included in a housing.
Figure 3B:
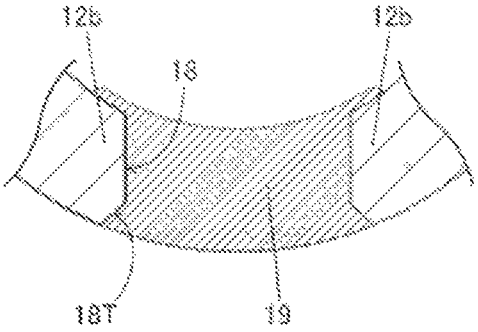
FIG. 3B is a cross-sectional view of an extending section taken along a plane passing through a second cut section.

FIG. 1 is a perspective view of the L-type coaxial connector 100. FIG. 2 is a perspective view that illustrates elements before the L-type coaxial connector 100 is assembled with the aim of facilitating the understanding of the shapes of the constituent elements of the L-type coaxial connector 100. That is, FIG. 2 illustrates a crimp section 14 described below in the state where it is not bent. FIG. 3A is an enlarged perspective view that illustrates an enlarged back-side section 12, which is a main part of the present disclosure, included in a housing 10 described below. FIG. 3B is a cross-sectional view of an extending section 12*b* taken along a plane passing through a second cut section 18.

The L-type coaxial connector 100 is connected to a coaxial cable 50 including a central conductor 51, an external conductor 52, an insulating film 53 insulating the central conductor 51 and external conductor 52 from each other, and a protective film 54. The coaxial cable 50 has a known structure. The L-type coaxial connector 100 includes a housing 10, a bushing 20, and a socket 30.

The housing 10 includes a housing main body 11, the back-side section 12, a support section 13, and the crimp section 14. The housing main body 11 has a substantially cylindrical shape and includes a first opening 15 and a second opening 16. The housing main body 11 has a first cut section 17 in its side surface. The back-side section 12 includes a lid section 12*a* covering the second opening 16 of the housing main body 11 and the extending section 12*b*, which extends from a location in the lid section 12*a* adjacent to the first cut section 17 and above which the external conductor 52 in the coaxial cable 50 is placed. The extending section 12*b* has the second cut section 18 described below. The housing 10 may be formed by using a metal material, such as a copper alloy.

In the L-type coaxial connector 100, a tin film or an alloy film containing tin, which is not illustrated, is provided to the side where the external conductor 52 is placed of the extending section 12*b*. Alternatively, the tin film or alloy film containing tin may not be provided on the extending section 12*b*.

The support section 13 is connected to the housing main body 11 and holds a bushing drawing section 22 described below. The crimp section 14 extends from the extending section 12*b*, and its leading end section is bent so as to be opposed to the extending section 12*b* such that the coaxial cable 50 is interposed therebetween.

In the L-type coaxial connector 100, the crimp section 14 is formed by bending a first-side crimp member 14*a* and a second-side crimp member 14*b* as described above. The first-side crimp member 14*a* includes a first member $\mathbf{14}a_1$, a second member $\mathbf{14}a_2$, and a third member $\mathbf{14}a_3$. The second-side crimp member 14*b* includes a first member $\mathbf{14}b_1$, a second member $\mathbf{14}b_2$, and a third member $\mathbf{14}b_3$. That is, the coaxial cable 50 is fixed to the extending section 12*b* by being interposed between the extending section 12*b* and the leading end section of the crimp section 14 and being pressed by both of them.

The bushing 20 includes a bushing main body 21 having a first opening 23 and having a cut section 24 in its side surface and the bushing drawing section 22 connected to the bushing main body 21 in a location adjacent to the cut section 24. The bushing 20 is attached inside the housing 10 such that the bushing drawing section 22 projects through the first cut section 17 in the housing main body 11. The bushing 20 may be formed by using an insulating resin material, such as polypropylene, nylon, or rubber.

The socket 30 includes a socket main body 31 having a first opening 33 and a socket drawing section 32 connected to the socket main body 31. The socket 30 is attached inside the bushing 20 in the state where the socket drawing section 32 projects through the cut section 24 in the bushing main body 21 and is connected to the central conductor 51 in the coaxial cable 50. The socket 30 may be formed by using a metal material, such as copper alloy.

The above-described second cut section 18 is a through hole having a first opening on a side corresponding to the external surface of the extending section 12*b* and a second opening on a side where the external conductor 52 in the coaxial cable 50 is placed, as illustrated in FIG. 3A. The perimeter of each of the first opening and the second opening of the through hole being the second cut section 18 is positioned in the extending section 12*b*. The through hole being the second cut section 18 has a tapered region 18T whose cross-sectional area increases in the direction from the second opening toward the first opening of the through hole, as illustrated in FIG. 3B.

The second cut section 18 may be formed such that, for example, a portion of its perimeter overlaps at least one of the first-side crimp member 14*a* and the second-side crimp member 14*b*. The second cut section 18 may also be formed by cutting a portion of a side part where the first-side crimp member 14*a* and second-side crimp member 14*b* are absent in the extending section 12*b*.

A joining member 19 joining the external conductor 52 in the coaxial cable 50 and the extending section 12*b* is present in at least a portion inside the second cut section 18, as described below. The joining member 19 may be formed by using an alloy containing tin, such as tin-based lead-free solder.

The joining member 19 may also be formed by using a metal material other than the alloy containing tin. The joining member 19 may also be formed by using a material containing a resin component, such as a thermosetting conductive adhesive.

In the L-type coaxial connector 100, fixing by the crimp section 14 and joining between the external conductor 52 and the extending section 12*b* by the joining member 19 are both used. That is, because the crimping by the crimp section 14 is not strong, deformation of the external conductor 52 and insulating film 53 in the coaxial cable 50 during connection is suppressed. Thus, deviation in impedance of the coaxial cable 50 is suppressed. Moreover, sufficient connection strength is maintained between the L-type coaxial connector 100 and the coaxial cable 50.

When the second cut section 18 is the through hole formed in the extending section 12*b*, because the joining member 19 is filled over the perimeters of the first opening and the second opening of the through hole, the joining strength between the external conductor 52 and the extending section 12*b* is high. In addition, when the through hole has the tapered region 18T, whose cross-sectional area increases in the direction from the second opening toward the first opening, because the previous structure of the joining member is easily held inside the through hole, the joining strength between the external conductor 52 and the extending section 12*b* is higher. Additionally, an overflow of the joining member 19 to the outer side of the extending section 12*b* is suppressed.

<Method For Manufacturing L-type Coaxial Connector>

One example of the L-type coaxial connector 100 can be manufactured through first to seventh steps described below. The steps are sufficiently understandable with reference to FIG. 2, and mention of drawings is omitted in the following description about the steps.

The first step is a step of preparing or producing constituent members. In the first step, the housing 10, bushing 20, and socket 30 are prepared or produced. The housing 10, bushing 20, and socket 30 have the above-described structures.

The second step is a step of attaching the socket. In the second step, the socket 30 is attached inside the bushing 20 such that the socket drawing section 32 projects through the cut section 24 in the bushing 20.

The third step is a step of attaching the bushing. In the third step, the bushing 20 with the socket 30 attached therein is attached inside the housing 10 such that the bushing drawing section 22 projects through the first cut section 17 in the housing 10. At that time, the bushing 20 is attached inside the housing 10 such that the socket 30 is insulated from the housing 10 by the bushing 20.

The fourth step is a step of providing the previous structure of the joining member. In the fourth step, the previous structure of the joining member is provided to at least a portion of the second cut section 18 in the extending section 12*b*. As the previous structure of the joining member, a tin alloy in the form of, for example, lead-free solder paste or wire lead-free solder may be used. The previous structure of the joining member can be provided by, for example, placing a caul for blocking the first opening of the second cut section 18 on the side corresponding to the external surface of the extending section 12*b* and filling a cavity formed by the caul and the second cut section 18 with the above-described previous structure of the joining member.

The fifth step is a step of placing the external conductor. In the fifth step, the central conductor 51 in the coaxial cable 50 and the socket 30 are connected together, and the exposed external conductor 52 is placed above the extending section 12*b*. The central conductor 51 in the coaxial cable 50 and the socket 30 are connected by causing the central conductor 51 in the coaxial cable 50 and the socket drawing section in the socket 30 to be in contact with each other.

The sixth step is a crimping step. In the sixth step, the leading end section of the first-side crimp member 14*a* (first member 14$a_1$ and third member 14$a_3$) and that of the second-side crimp member 14*b* (first member 14b$b_1$ and third member 14$b_3$) are bent so as to be opposed to the extending section 12*b* such that the coaxial cable 50 is interposed therebetween. This results in the crimp section 14.

The seventh step is a joining step. In the seventh step, the previous structure of the joining member is heated and formed into the joining member 19 joining the external conductor 52 in the coaxial cable 50 and the extending section 12*b*.

With the method for manufacturing the L-type coaxial connector 100 described above, the L-type coaxial connector 100 to which the coaxial cable 50 is fixed with sufficient connection strength without strong crimping by the crimp section 14 can be manufactured efficiently.

Second Embodiment of L-type Coaxial Connector

<Structure of L-type Coaxial Connector>

The structure of an L-type coaxial connector 200 being a second embodiment of the L-type coaxial connector according to the present disclosure is described with reference to FIG. 4.

Figure 4:
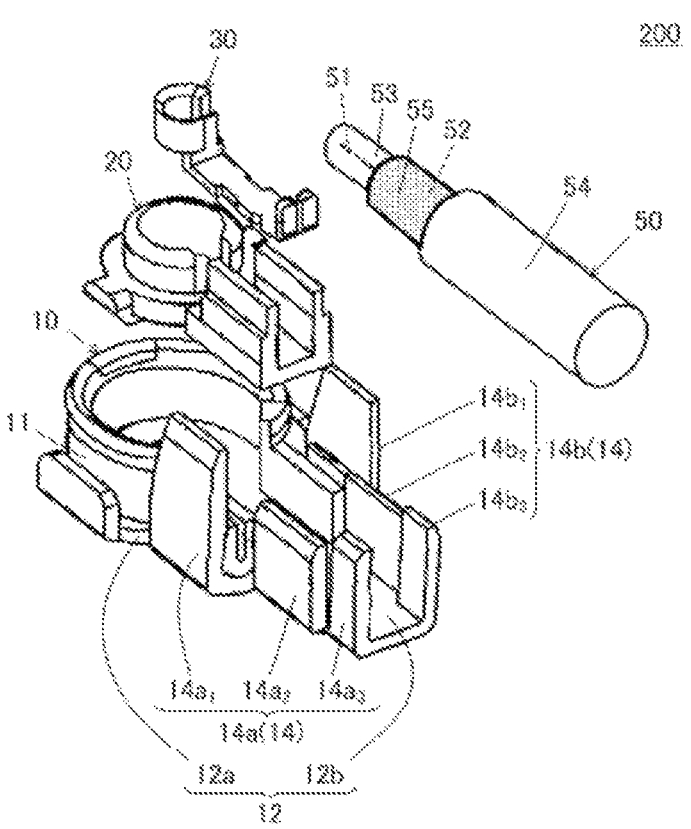
FIG. 4 is a perspective view that illustrates elements before an L-type coaxial connector being a second embodiment of the L-type coaxial connector according to the present disclosure is assembled.
Figure 5:
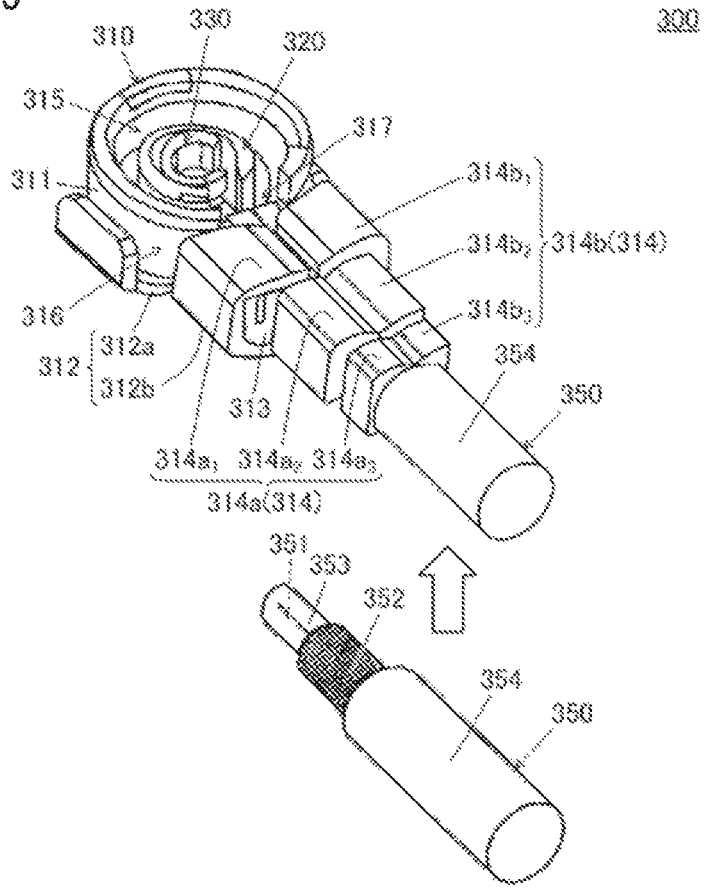
FIG. 5 is a perspective view of an L-type coaxial connector in the related art.

FIG. 4 is a perspective view that illustrates elements before the L-type coaxial connector 200 is assembled. As is clear from comparison between FIGS. 2 and 4, the L-type coaxial connector 200 differs from the L-type coaxial connector 100 in how the external conductor 52 in the coaxial cable 50 and the extending section 12*b* are joined together. The other constituent elements are substantially the same as those in the L-type coaxial connector 100, and further description about them is omitted here.

In the L-type coaxial connector 200, a joining member 55 joining the external conductor 52 in the coaxial cable 50 and the extending section 12*b* is present in substantially all of an exposed section of the external conductor 52 between the external conductor 52 and the extending section 12*b*. The joining member 55 may be present in a portion between the external conductor 52 and the extending section 12*b*. The joining member 55 may be formed by using an alloy containing tin, such as tin-based lead-free solder, as in the case of the joining member 19 in the L-type coaxial connector 100.

The joining member 55 may be formed by using a metal material other than the alloy containing tin. The joining member 55 may be formed by using a material containing a resin component, such as a thermosetting conductive adhesive.

In the L-type coaxial connector 200, fixing by the crimp section 14 and joining between the external conductor 52 and the extending section 12*b* by the joining member 55 are also both used. That is, as in the case of the L-type coaxial connector 100, because the crimping by the crimp section 14 is not strong, deformation of the external conductor 52 and insulating film 53 in the coaxial cable 50 during connection is suppressed. Thus, deviation in impedance of the coaxial cable 50 is suppressed. Moreover, sufficient connection strength is maintained between the L-type coaxial connector 200 and the coaxial cable 50.

<Method for Manufacturing L-type Coaxial Connector>

One example of the L-type coaxial connector 200 can be manufactured through first to seventh steps described below. The steps are sufficiently understandable with reference to FIG. 4, and mention of drawings is omitted in the following description about the steps.

The first to third and sixth steps are substantially the same as the corresponding steps in the method for manufacturing the L-type coaxial connector 100, and further description about them is omitted here.

This fourth step is a step of providing the previous structure of the joining member. In the fourth step, the previous structure of the joining member is provided to at least a portion of the exposed external surface of the external conductor 52. As the previous structure of the joining member, a tin alloy in the form of, for example, lead-free solder paste or pre-coating of lead-free solder may be used. The previous structure of the joining member can be provided by providing the previous structure of the joining member to the external surface of the external conductor 52 by a known means.

The fifth step is a step of placing the external conductor. In the fifth step, the central conductor 51 in the coaxial cable 50 and the socket 30 are connected together, and the external conductor 52 is placed above the extending section 12*b* such that the previous structure of the joining member is present in at least a portion between the external conductor 52 and the extending section 12*b*. The connection between the central conductor 51 in the coaxial cable 50 and the socket 30 is substantially the same as that in the method for manufacturing the L-type coaxial connector 100.

The seventh step is a joining step. In the seventh step, the previous structure of the joining member is heated and formed into the joining member 55 joining the external conductor 52 in the coaxial cable 50 and the extending section 12*b*.

With the method for manufacturing the L-type coaxial connector 200 described above, the L-type coaxial connector 200 to which the coaxial cable 50 is fixed with sufficient connection strength without strong crimping by the crimp section 14 can be manufactured efficiently.

The embodiments described in the present specification are illustrative, and the present disclosure is not restricted to the above-described embodiments. Various applications and modifications may be made within the scope of the present disclosure.

What is claimed is:

1. An L-type coaxial connector connected to a coaxial cable including a central conductor, an external conductor, and an insulating film that insulates the central conductor and the external conductor from each other, the L-type coaxial connector comprising:

a housing;

a bushing attached inside the housing;

and a socket attached inside the bushing in a state where the socket is insulated from the housing by the bushing and is connected to the central conductor, wherein the housing includes a housing main body having a side surface formed between a first opening and a second opening and having a first cut section formed in the side surface thereof, a back-side section including a lid section covering the second opening of the housing main body and an extending section extending from the lid section and above which the external conductor is placed, and a crimp section extending from the extending section and having a leading end section bent so as to be opposed to the extending section such that the coaxial cable is interposed therebetween, the extending section has a second cut section, and a joining member that joins the external conductor and the extending section is present in at least a portion inside the second cut section before the joining member is heated.

2. The L-type coaxial connector according to claim 1, wherein the second cut section is a through hole having a first opening on a side corresponding to an external surface of the extending section and a second opening on a side where the external conductor is placed, and a perimeter of each of the first opening of the through hole and the second opening of the through hole is positioned in the extending section.

3. The L-type coaxial connector according to claim 2, wherein the through hole has a tapered region whose cross-sectional area increases in a direction from the second opening of the through hole toward the first opening of the through hole.

4. An L-type coaxial connector connected to a coaxial cable including a central conductor, an external conductor, and an insulating film that insulates the central conductor and the external conductor from each other, the L-type coaxial connector comprising:

a housing electrically connected to the external conductor;

a socket electrically connected to the central conductor, a bushing with electrical insulation properties, is arranged between the housing and the socket, and is attached inside the housing, and a joining member that joins the external conductor of the coaxial cable and the housing; wherein the housing includes a crimp section with a cut section, the crimp section crimps the coaxial cable, the housing fixes the external conductor of the coaxial cable with the joining member formed in the cut section when the joining member is heated, and the housing includes an extending section above which the external conductor is placed, the crimp section extends from the extending section, and the cut section is formed in the extending section.

5. The L-type coaxial connector according to claim 1, wherein the joining member is formed of an alloy containing tin.

6. The L-type coaxial connector according to claim 5, wherein a tin film or an alloy film containing tin is provided to a side of the extending section, where the external conductor is placed of the extending section.

7. The L-type coaxial connector according to claim 2, wherein the joining member is formed of an alloy containing tin.

8. The L-type coaxial connector according to claim 3, wherein the joining member is formed of an alloy containing tin.

9. The L-type coaxial connector according to claim 4, wherein the joining member is formed of an alloy containing tin.

10. The L-type coaxial connector according to claim 7, wherein a tin film or an alloy film containing tin is provided to the side of the extending section, where the external conductor is placed.

11. The L-type coaxial connector according to claim 8, wherein a tin film or an alloy film containing tin is provided to the side of the extending section, where the external conductor is placed.

12. The L-type coaxial connector according to claim 9, wherein a tin film or an alloy film containing tin is provided to a side of the extending section, where the external conductor is placed.

13. A method for manufacturing an L-type coaxial connector connected to a coaxial cable including a central conductor, an external conductor, and an insulating film that insulates the central conductor and the external conductor from each other, the method comprising:

preparing or producing a housing, a bushing, and a socket, the housing including a housing main body, a back-side section, and a crimp member, the housing main body having a side surface formed between a first opening and a second opening and having a first cut section formed in the side surface, the back-side section including a lid section covering the second opening of the housing main body and an extending section extending from the lid section and having a second cut section, the crimp member extending from the extending section;

attaching the socket inside the bushing;

attaching the bushing with the socket attached therein inside the housing such that the socket is insulated from the housing by the bushing;

providing a material to be a joining member to at least a portion of the second cut section;

connecting the central conductor and the socket and placing an exposed external conductor above the extending section;

forming a crimp section by bending a leading end section of the crimp member so as to be opposed to the extending section such that the coaxial cable is interposed therebetween; and heating the material to be the joining member to form the joining member joining the external conductor and the extending section.

14. A method for manufacturing an L-type coaxial connector connected to a coaxial cable including a central conductor, an external conductor, and an insulating film that insulates the central conductor and the external conductor from each other, the method comprising:

preparing or producing a housing, a bushing, and a socket, the housing including a housing main body, a back-side section, and a crimp member, the housing main body having a side surface formed between a first opening and a second opening and having a first cut section formed in the side surface, the back-side section including a lid section covering the second opening of the housing main body and an extending section extending from the lid section, the crimp member extending from the extending section; attaching the socket inside the bushing;

attaching the bushing with the socket attached therein inside the housing such that the socket is insulated from the housing by the bushing;

providing a material to be a joining member to at least a portion of an exposed external surface of the external conductor;

connecting the central conductor and the socket and placing the external conductor above the extending section such that the material to be the joining member is present in at least a portion between the external conductor and the extending section;

forming a crimp section by bending a leading end section of the crimp member so as to be opposed to the extending section such that the coaxial cable is interposed therebetween; and heating the material to be the joining member to form the joining member joining the external conductor and the extending section.

* * * * *